US007484270B2

(12) United States Patent
Balbo Di Vinadio

(10) Patent No.: US 7,484,270 B2
(45) Date of Patent: Feb. 3, 2009

(54) DISAPPEARING HINGING DEVICE FOR WINDOWS AND DOORS WITH WING AND SWIVEL WING OPENING

(75) Inventor: Aimone Balbo Di Vinadio, Turin (IT)

(73) Assignee: SAVIO S.p.A., Chiusa San Michele (Turin) (IT)

( * ) Notice: Subject to any disclaimer, the term of this patent is extended or adjusted under 35 U.S.C. 154(b) by 515 days.

(21) Appl. No.: 11/157,698

(22) Filed: Jun. 21, 2005

(65) Prior Publication Data

US 2005/0283947 A1 Dec. 29, 2005

(30) Foreign Application Priority Data

Jun. 28, 2004 (IT) ..... TO2004A0438

(51) Int. Cl.
*E05D 11/06* (2006.01)

(52) U.S. Cl. ..... 16/360; 16/370

(58) Field of Classification Search ..... 16/360, 16/357, 361, 362, 367, 368, 370; 292/DIG. 7; 49/192, 193, 382
See application file for complete search history.

(56) References Cited

U.S. PATENT DOCUMENTS 3,911,621 A * 10/1975 McHeffey ..... 49/192
3,994,093 A * 11/1976 Mayer et al. ..... 49/192

(Continued)

FOREIGN PATENT DOCUMENTS

DE 202004003419 U1 5/2004
EP 0360024 A1 3/1990
EP 0385414 A1 9/1990

OTHER PUBLICATIONS

European Search Report; Dated Mar. 12, 2007; from corresponding EP Application #05013227.3.

*Primary Examiner*—Victor Batson
*Assistant Examiner*—Jeffrey O'Brien
(74) *Attorney, Agent, or Firm*—Heslin Rothenberg Farley & Mesiti P.C.; Victor A. Cardona, Esq.

(57) ABSTRACT

A hinging device for windows and doors includes a fixed frame and a movable frame, a first support element, a second support element, a main lever, a secondary lever, and a connecting arm. The first support element is fastened to the fixed frame bearing a main axis of articulation. The second support element is fastened to the movable frame. The main lever has a first end articulated to the first support element around the main axis of articulation. The secondary lever is articulated to an intermediate region of the main lever. A second end of the secondary lever is articulated to the second support element around a first axis of articulation. The connecting rod has a first end articulated to the second end of the main lever and a second end articulated to the second support element around a second axis of articulation. The first and the second axes of articulation are in a fixed position relative to the second support element and they can be inclined in such a way as to allow a displacement of the second support element between a first position corresponding to the position of closed or wing-opened movable frame and a second position corresponding to the position of swivel-opened movable frame.

8 Claims, 4 Drawing Sheets

Figure 3:
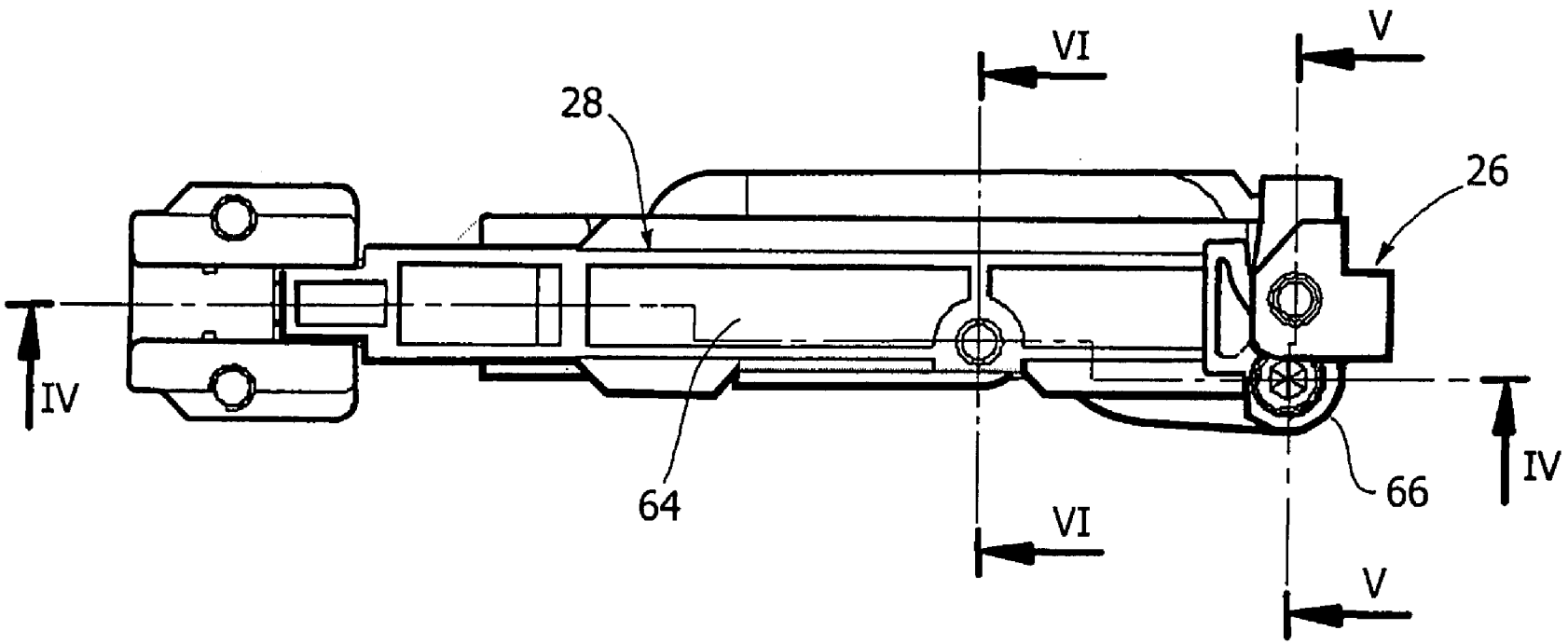

U.S. PATENT DOCUMENTS 4,035,953 A * 7/1977 Bierlich ..... 49/192
4,679,352 A * 7/1987 Bates ..... 49/192
4,986,028 A * 1/1991 Schneider et al. ..... 49/248
5,052,079 A * 10/1991 Vosskotter ..... 16/367
5,081,741 A * 1/1992 Aumercier ..... 16/238
2005/0284025 A1 12/2005 Balbo Di Vinadio

* cited by examiner

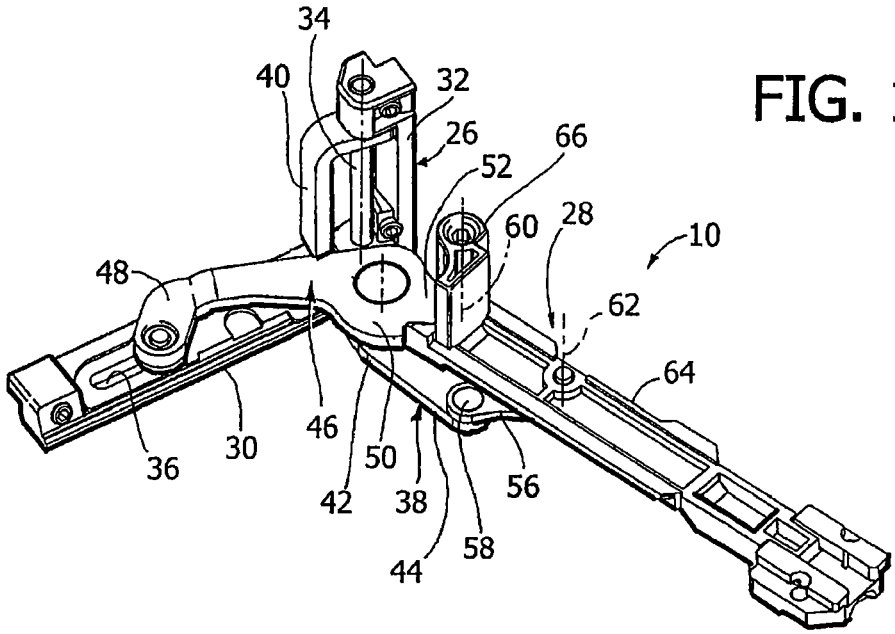
FIG. 1
FIG. 2
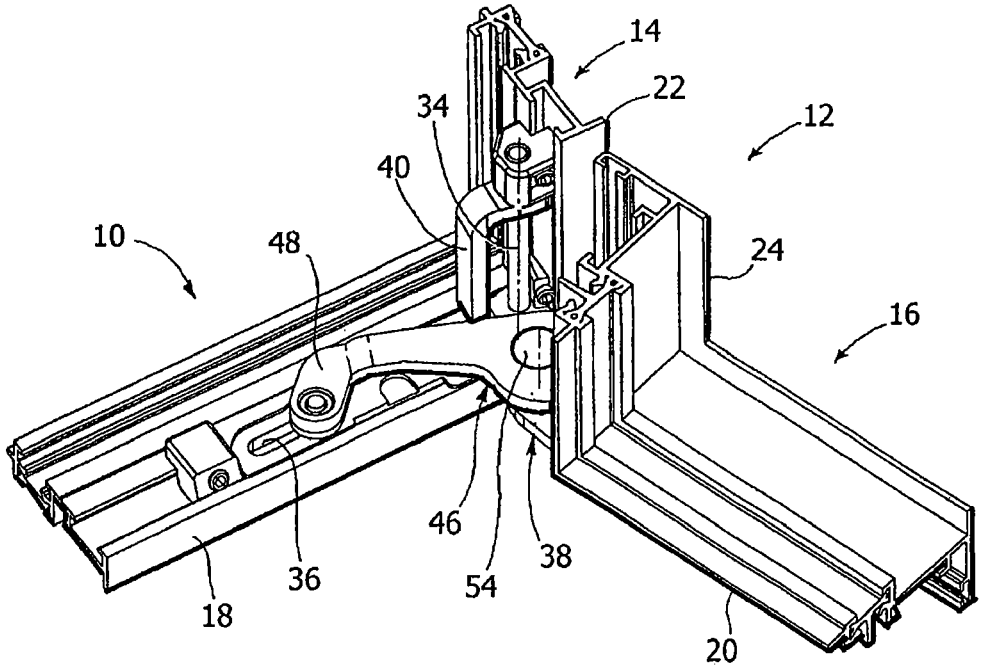

DISAPPEARING HINGING DEVICE FOR WINDOWS AND DOORS WITH WING AND SWIVEL WING OPENING

CROSS REFERENCE TO RELATED APPLICATIONS

This application claims priority from Italian patent application TO 2004 A 000438, filed on Jun. 28, 2004, the entire disclosure of which is incorporated herein by reference.

This application also relates to U.S. patent application Ser. No. 11/158,091, filed on the same day as the present patent application, and titled "UPPER ARTICULATION ASSEMBLY FOR WINDOWS AND DOORS WITH WING AND SWIVEL WING OPENING", which claims priority from Italian patent application TO 2004 A 000439, the contents of which are incorporated herein by reference.

TEXT OF THE DESCRIPTION

The present invention relates to a hinging device for windows and doors including a fixed frame and a movable frame, such as windows, French windows and the like.

The present invention was developed for application to light alloy windows and doors, but it is not limited to this kind of windows and doors.

The invention relates in particular to so-called "disappearing" hinging devices, which are invisible when the movable frame is in the closed position. A hinging device of this kind is illustrated in Italian utility model no. TO96U000013 by the same Applicant, which discloses a device having the characteristics set out in the preamble to the main claim. This document describes a hinging device including a main lever and a secondary lever connected to each other in articulated fashion in such a way as to allow an opening of the movable frame by rotation around a vertical axis (wing opening). The articulation device described in this document causes the movable frame, during the opening motion, to move laterally outwards relative to the fixed frame in such a way as to obtain a very wide angle of opening (e.g. close to 180°) without reducing the opening span of the fixed frame. The hinging device disclosed by this document, however, allows to obtain only a wing opening of the movable frame.

The document EP 0 360 024 describes a hinging device of the disappearing type which allows a movable frame to open by rotation around a vertical axis (wing opening) or by rotation around a lower horizontal axis (swivel wing opening). The hinging device disclosed by this document, however, does not permit ample angles of opening of the movable frame to be obtained during the wing opening.

The object of the present invention is to provide a hinging device of a disappearing type which allows a wing and swivel wing opening of a movable frame with a high angle of wing opening.

According to the present invention, the object is achieved by a hinging device having the characteristics set out in the main claim.

Figure 4:
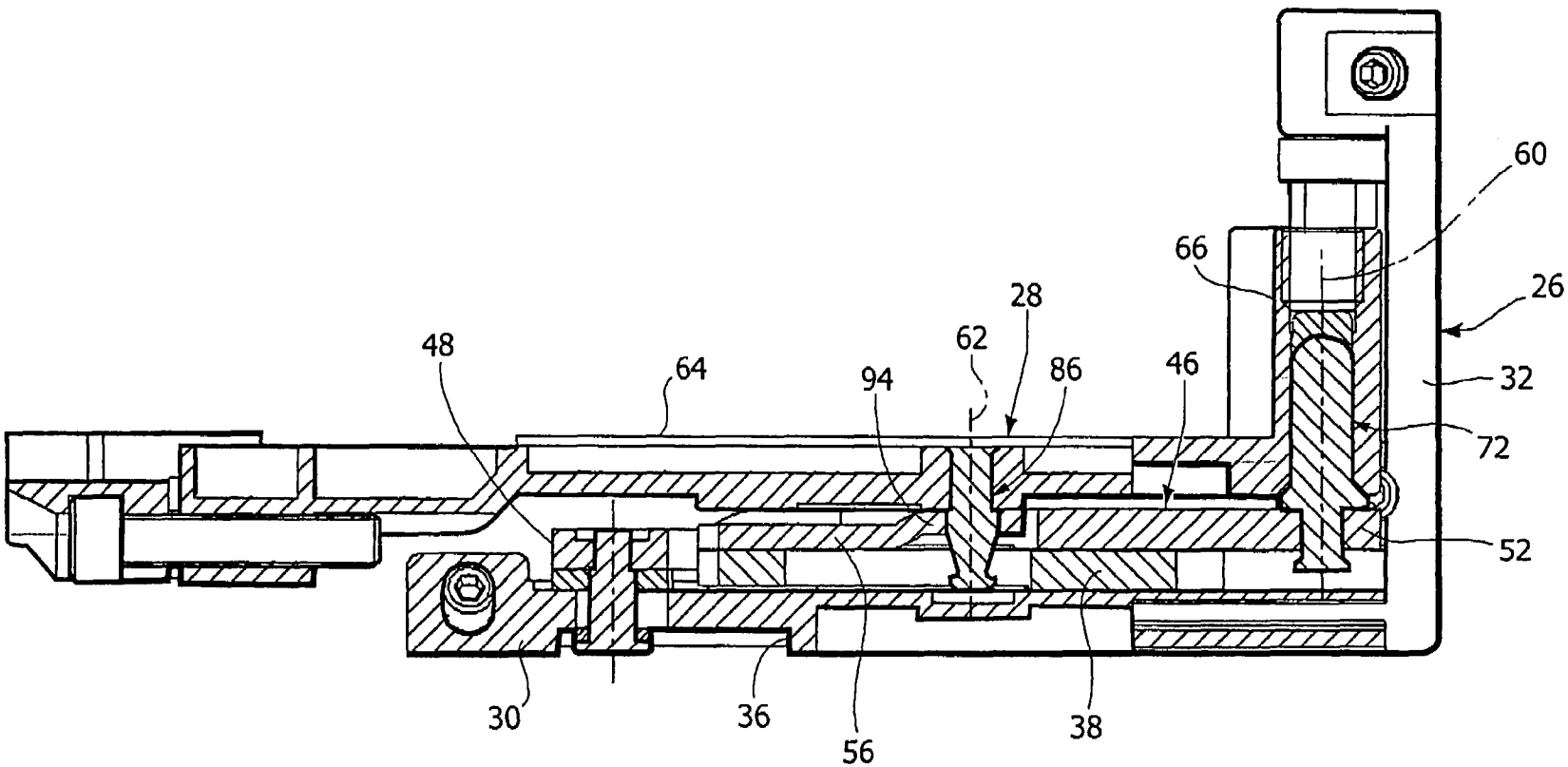
Figure 6:
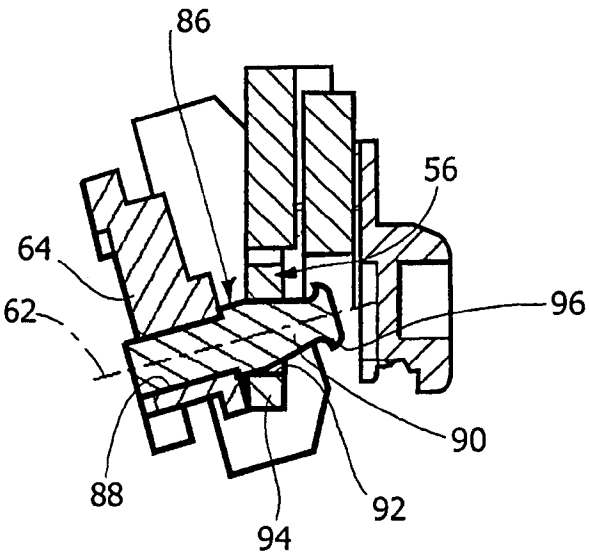
Figure 5:
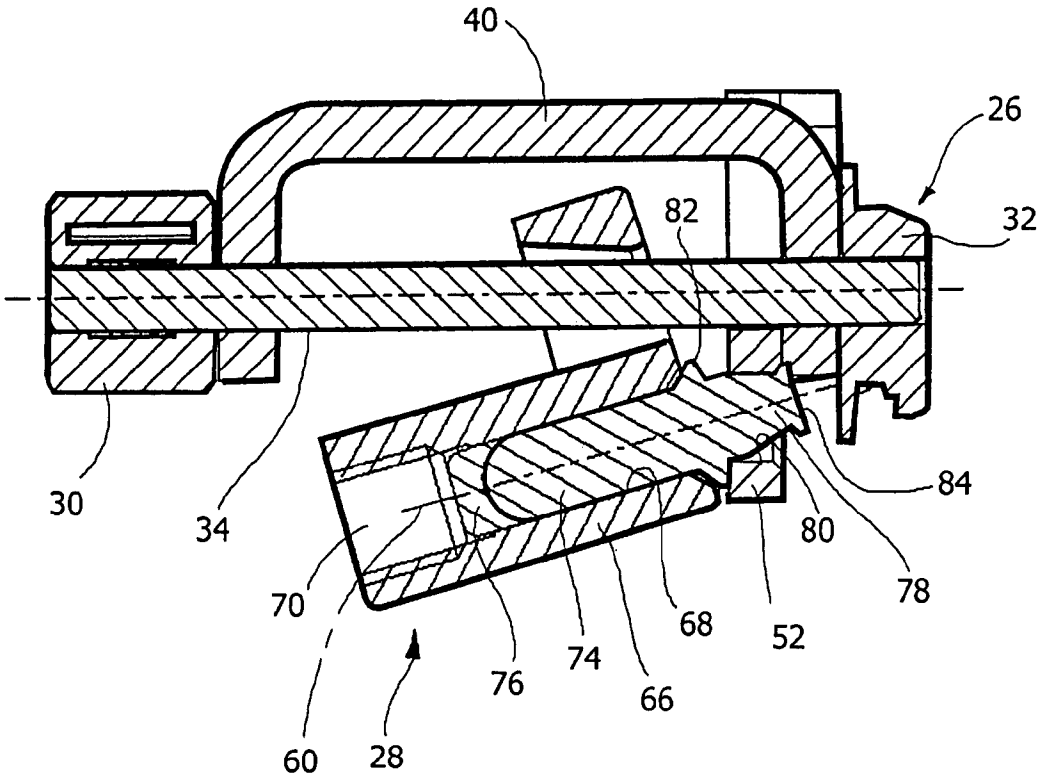

The characteristics and the advantages of the present invention shall become readily apparent in the detailed description that follows, provided purely by way of non limiting example, with reference to the accompanying drawings, in which:

FIG. 1 is a perspective view of a hinging device according to the present invention, FIG. 2 is a perspective view of the device of FIG. 2 mounted on a window or door, FIG. 3 is a plan view of the hinging device of FIG. 1 in the closed position, FIG. 4 is a section according to the line IV-IV of FIG. 3, and FIGS. 5 and 6 are sections respectively according to the lines V-V and VI-VI of FIG. 3, illustrating the hinging device in the swivel opening position.

With reference to FIGS. 1 and 2, the number 10 designates a hinging device according to the present invention, to be used to achieve the lower articulation of a window or door openable in wing or swivel wing fashion. In FIG. 2, the device 10 is shown in mounted condition on a window or door 12 formed by a fixed frame 14 and by a movable frame 16. The fixed frame 14 and the movable frame 16 comprise respective lower cross members 18, 20 and respective uprights 22, 24 shown only partially in FIG. 2.

The hinging device 10 comprises a first support element 26 to be fastened to the fixed frame 14 and a second support element 28 to be fastened to the movable frame 16.

The first support element 26 is constituted by a monolithic piece of die-cast metallic material with an "L" shape having a horizontal branch 30 fastened to the lower cross member 18 and a vertical branch 32 fastened to the upright 22 of the fixed frame 14. The vertical branch 32 of the support element 26 bears a main articulation pivot pin 34 with elongated shape which extends in the vertical direction and is fastened at both its ends to the first support element 26. The longitudinal axis of the pivot pin 34 defines a main axis of articulation. The horizontal branch 30 of the first support element 26 has a guiding groove 36 which extends orthogonally relative to the main axis of articulation.

The hinging device 10 comprises a main lever 38 articulated on the pivot pin 34 around the main axis of articulation. The main lever 38 has a first end portion 40, an intermediate portion 42 and a second end portion 44. The first end portion 40 is substantially "C" shaped and extends parallel to the vertical branch 32 of the first support element 26. The first end portion 40 of the main lever 38 rotatably engages the pivot pin 34 on two regions, axially distanced from each other and positioned in proximity to the ends of the pivot pin fastened to the first support element 26.

The device 10 comprises a secondary lever 46 having a first end portion 48, an intermediate portion 50 and a second end portion 52. The first end 48 of the secondary lever 46 is articulated in slidable fashion in the guiding groove 36 of the first support element 26. The intermediate portion 50 of the secondary lever 46 is articulated to the intermediate portion 42 of the main lever 38 by means of a pivot pin whose axis is parallel to the main axis of articulation.

The device 10 further comprises a connecting rod 56 having a first end articulated to the second end 44 of the main lever 38 by means of a pivot pin 58 with its axis parallel to the main axis of articulation.

The second end 52 of the secondary lever 46 and the second end of the connecting rod 56 are articulated to the second support element 28 around respective axes 60, 62 parallel to each other. The two axes of articulation 60, 62 are in fixed position relative to the second support element 28 and they can be inclined relative to the second end of the secondary lever 46 and relative to the second end of the connecting rod 56 in such a way as to allow a displacement of the second support element between a first position corresponding to the position of closed or wing-opened window or door and a second position corresponding to the position of swivel-opened window or door. The movement from the first to the second position of the second support element 28 corresponds to the swivel-opening movement of the movable frame 16. The articulation device 10 further allow a wing-opening movement of the movable frame 16 during which the movable frame 16 rotates and moves outwardly relative to the fixed frame 14. The geometry of the hinging device 10 allows to obtain a wide wing-opening angle of the movable frame 16, typically greater than 90° and for example in the order of 110°. In the closed configuration of the window or the like, the hinging device 10 is entirely contained in the space between the cross members 18, 20 and the uprights 22, 24 and it is invisible from the exterior.

FIGS. 4, 5 and 6 show the manner in which the second support element 28 is connected in articulated fashion to the secondary lever 46 and to the connecting rod 56. With reference in particular to FIGS. 4 and 5, the second support element 28 has a horizontal portion 64 destined to be fastened to the lower cross member 20 and a vertical portion 66 to be fastened to the upright 24 of the movable frame 16. The vertical portion 66 has a through hole with a smooth portion 68 and an upper threaded segment in which is engaged a dowel 70 which closes the upper part of the hole 68. A first articulation pivot pin 72 has a cylindrical portion 74 which rotatably engages the hole 68. The upper end of the pivot pin 72 has hemispherical shape and bears against a convex hemispherical surface of a dowel of plastic material 76 positioned between the threaded dowel 70 and the pivot pin 72. The pivot pin 72 has a portion 78 having cone frustum or pyramid frustum shape which engages a through hole 80 formed at the second end 52 of the secondary lever 46. Between the cylindrical portion 74 and the cone frustum or pyramid frustum 78 of the pivot pin 72 is formed a radial shoulder 82. The lower end of the pivot pin 72 has a head 84 obtained by riveting the end of the pivot pin after inserting the portion 78 into the hole 80. The head 84 prevents the pivot pin 72 from disengaging from the hole 80. The portion 78 of the pivot pin 72 engages the hole in non rotatable fashion. This is obtained e.g. providing planar portions on the portion 78 and in the hole 80 which prevent the rotation of the pivot pin 72. The pivot pin 72 is free to position itself relative to the hole 80 in a vertical position in which the axis 60 is coaxial relative to the axis of the hole 80 and parallel to the main axis of articulation (axis of the pivot 34) and an inclined position shown in FIG. 5 in which the axis 60 of the pivot pin 72 is inclined relative to the main axis of articulation.

With reference to FIGS. 4 and 6, the horizontal portion 64 of the second support element 28 bears a second articulation pivot pin 86. The second pivot pin 86 is fastened in a hole 88 of the horizontal portion 64 of the second support element 28. The second articulation pivot pin 86 has a cone frustum portion 90 which engages with play a hole 92 formed at the second end 94 of the connecting rod 56. The lower end of the pivot pin 86 ends with a widened portion 96. The axes 60, 62 of the two articulation pivot pins 72, 86 are always in fixed position relative to the second support element 28 and therefore remain constantly parallel to each other. The second articulation pivot pin 86 is movable relative to the second end 94 of the connecting rod 56 between a first position in which the axis 62 is parallel to the main axis of articulation and a second position in which the axis 62 is inclined relative to the main axis of articulation (swivel-wing opening position).

Naturally, without altering the principle of the invention, the construction details and the embodiments may be widely varied from what is described and illustrated herein without thereby departing from the scope of the invention as defined by the claims that follow.

The invention claimed is:

1. A hinging device for windows and doors including a fixed frame and a movable frame, comprising:

a first support element to be fastened to the fixed frame, bearing a vertical main axis of articulation, and the first support element bearing a sliding guide orthogonal to the main axis of articulation, a second support element to be fastened to the movable frame, a main lever having a first end, an intermediate region and a second end, in which said first end of the main lever is articulated to the first support element around said main axis of articulation, a secondary lever having a first end, a second end and an intermediate region, in which the first end of the secondary lever is slidably articulated to the first support element in said sliding guide, in which the intermediate region of the secondary lever is articulated to the intermediate region of the main lever around a second axis of articulation parallel to the main axis of articulation, and in which the second end of the secondary lever is articulated to the second support element around a third axis of articulation, a connecting rod having a first end articulated to the second end of the main lever and a second end articulated to the second support element around a fourth axis of articulation, a first axis of articulation defined by a first pivot pin which rotatably engages a hole formed in a vertical portion of the second support element, said first pivot pin having a first tapered portion which is tiltable in a hole of the second end of the secondary lever, in such a way as to allow an inclination of the first pivot pin with respect to the secondary lever between a first and a second position, the first pin having a first pin axis substantially parallel to the main axis of articulation in the first position and the first pin axis being non-parallel to the main axis in the second position; and wherein the second axis of articulation is defined by a second pivot pin fastened to the second support element, the second pivot pin having a second tapered portion which is tiltable in a hole of the second end of the connecting rod in such a way as to allow an inclination of the second pivot pin with respect to the connecting rod between a first and a second position, the second pin having a second pin axis substantially parallel to the main axis of articulation in the first position and the second pin axis being non-parallel to the main axis in the second position.

2. Device as claimed in claim 1, wherein the first pivot pin has a hemispherical upper end which bears against a complementary hemispherical portion of a bushing of plastic material inserted in said hole of the second support element.

3. The device of claim 1 wherein the first pin axis is tiltable relative to an axis of the hole of the second end of the secondary lever and the second pin axis is tiltable relative to an axis of the hole of the second end of the connecting rod.

4. The device of claim 1 wherein the first pin comprises a radial shoulder between said second end of said second lever and the vertical portion of the second support element.

5. The device of claim 4 wherein the tapered portion of the first pin is located below the radial shoulder.

6. The device of claim 1 wherein the tapered portion of the first pin is located in the hole of the second end of the secondary lever, the hole of the second end having a diameter larger than a diameter of the tapered portion of the first pin.

7. The device of claim 4 wherein the tapered portion extends from the shoulder through the hole of the second end of the second lever to a head, the tapered portion having a tapered portion end connected to the head, the tapered portion end having a diameter smaller than a diameter of the head, the diameter of the head being larger than the diameter of the hole of the second end of the second lever.

8. The device of claim 1 wherein the tapered portion of the pin decreases in diameter as the pin extends vertically downwardly.

* * * * *